US005463274A

United States Patent [19]

Winsor

[11] Patent Number: 5,463,274

[45] Date of Patent: Oct. 31, 1995

[54] PLANAR FLUORESCENT LAMP HAVING A SERPENTINE CHAMBER AND SIDEWALL ELECTRODES

[75] Inventor: Mark D Winsor, Olympia, Wash.

[73] Assignee: Winsor Corporation, Seattle, Wash.

[21] Appl. No.: 289,377

[22] Filed: Aug. 12, 1994

Related U.S. Application Data

[63] Continuation of Ser. No. 990,068, Dec. 14, 1992, Pat. No. 5,343,116.

[51] Int. Cl.[6] ..... H01J 17/04; H01J 61/067

[52] U.S. Cl. ..... 313/493; 313/491

[58] Field of Search ..... 313/493, 491, 313/581, 595

[56] References Cited

U.S. PATENT DOCUMENTS

| | | | |
|---|---|---|---|
| 1,984,215 | 12/1934 | Hotchner | 176/14 |
| 2,255,431 | 9/1941 | Marden et al. | 176/122 |
| 2,405,518 | 8/1946 | Polevitzky | 176/122 |
| 2,555,749 | 6/1951 | Krefft | 313/109 |
| 2,733,368 | 1/1956 | Kolkman | 313/109 |
| 2,774,918 | 12/1956 | Lemmers | 315/98 |
| 2,900,545 | 8/1959 | Rulon et al. | 313/108 |
| 3,047,763 | 7/1962 | Inman | 313/109 |
| 3,121,184 | 2/1964 | Fox | 313/207 |
| 3,198,943 | 8/1965 | Pistey | 240/51.11 |
| 3,226,590 | 12/1965 | Christy | 313/109 |
| 3,253,176 | 5/1966 | Pate et al. | 313/204 |
| 3,258,630 | 6/1966 | Scott | 313/109 |
| 3,508,103 | 4/1970 | Young | 313/109 |
| 3,646,383 | 2/1972 | Jones et al. | 313/109 |
| 3,967,153 | 6/1976 | Milke et al. | 313/489 |
| 4,079,288 | 3/1978 | Maloney et al. | 313/489 |
| 4,117,374 | 9/1978 | Witting | 315/99 |
| 4,234,817 | 11/1980 | Teshima et al. | 313/493 |
| 4,245,179 | 1/1981 | Buhrer | 315/248 |
| 4,266,167 | 5/1981 | Proud et al. | 315/248 |
| 4,312,028 | 1/1982 | Hamacher | 362/369 |

(List continued on next page.)

FOREIGN PATENT DOCUMENTS

| | | | |
|---|---|---|---|
| 3922865A1 | 1/1991 | Germany | H01J 65/04 |
| 2078147 | 3/1990 | Japan . | |
| 2244552 | 9/1990 | Japan . | |
| 3246865 | 11/1991 | Japan . | |
| 3285249 | 12/1991 | Japan . | |
| 4095337 | 3/1992 | Japan . | |
| 4147554 | 5/1992 | Japan . | |
| 2247977 | 3/1992 | United Kingdom | G09F 9/35 |
| WO92/02947 | 2/1992 | WIPO | H01J 61/30 |

OTHER PUBLICATIONS

Mercer et al., "Fluorescent backlights for LCDs," *Information Display*, Nov., pp. 8–13, 1989.

Sanyo Electric Co., Ltd., "Flat Fluorescent Lamp Specifications," dated before the date of applicant's invention.

Hinotani et al., "Flat Fluoresence Lamp for LCD Back-light," *International Display Research Conference*, 1988.

*Primary Examiner*—Ulysses Weldon
*Assistant Examiner*—Matthew Luu
*Attorney, Agent, or Firm*—Seed and Berry

[57] ABSTRACT

A planar fluorescent lamp having a sealed chamber and divider walls to create a serpentine discharge path is provided with sidewall electrodes. A plurality of sidewall electrodes are spaced from each other and positioned adjacent each sidewall of the sealed chamber. In a preferred embodiment, the sidewall electrodes are planar, cold electrode plates. The electrodes extend generally from one divider wall to the other divider wall along a single sidewall. In alternative embodiments, the sidewall electrodes are positioned within the chamber directly exposed to the mercury vapor, or, alternatively, are separated from the chamber by a dielectric layer. The sidewall electrodes are powered in pairs, each pair being driven at a different frequency than any other pair. Providing sidewall electrodes increases the uniformity of light emission from the lamp as well as increasing the overall range over which the light can be dimmed, aids in starting the lamp and increasing the overall brightness of the light output from the lamp.

19 Claims, 5 Drawing Sheets

U.S. PATENT DOCUMENTS

| | | | |
|---|---|---|---|
| 4,363,998 | 12/1982 | Graff et al. | 313/487 |
| 4,549,110 | 10/1985 | Berman et al. | 313/485 |
| 4,698,547 | 10/1987 | Grossman et al. | 313/485 |
| 4,710,679 | 12/1987 | Budinger et al. | 315/58 |
| 4,743,799 | 5/1988 | Loy | 313/493 |
| 4,767,965 | 8/1988 | Yamano et al. | 313/491 |
| 4,772,819 | 9/1988 | Ridders | 313/493 |
| 4,803,399 | 2/1989 | Ogawa et al. | 313/493 |
| 4,839,555 | 6/1989 | O'Mahoney | 313/493 |
| 4,851,734 | 7/1989 | Hamai et al. | 313/485 |
| 4,899,080 | 2/1990 | Vriens et al. | 313/477 R |
| 4,916,352 | 4/1990 | Haim et al. | 313/25 |
| 4,916,356 | 4/1990 | Ahern et al. | 313/336 |
| 4,916,359 | 4/1990 | Jönsson | 313/489 |
| 4,920,298 | 4/1990 | Hinotani et al. | 313/493 |
| 5,220,249 | 6/1993 | Tsukada | 313/493 |

PLANAR FLUORESCENT LAMP HAVING A SERPENTINE CHAMBER AND SIDEWALL ELECTRODES

CROSS-REFERENCE TO RELATED APPLICATION

This application is a continuation of U.S. patent application Ser. No. 07/990,068, filed Dec. 14, 1992, now U.S. Pat. No. 5,343,116.

TECHNICAL FIELD

This invention is related to planar fluorescent lamps, and more particularly to a planar fluorescent lamp having a serpentine chamber with electrodes at each end of the serpentine chamber creating a discharge arc and sidewall electrodes for modifying the shape of the discharge arc within the serpentine chamber.

BACKGROUND OF THE INVENTION

Thin, planar, and relatively large area light sources are needed in many applications. Back lights must often be provided for LCD's to make them readable in all environments. As is known, LCD's require a minimum amount of light in order to be read. For some environments, relatively bright lights are required to permit the reading of LCD displays.

One of the problems associated with providing light for LCD's is that the lights should take up as small an area as possible. Thus, thin back lights are desired to preserve as much as possible the LCD's traditional strengths of thin profile, low cost, and versatility of use, while permitting readability of the LCD's at all times. Lamps for use in the avionic environment, such as airplane cockpits, are preferably lightweight and thin, but must put out a high intensity of light in order to be useful for reading an LCD.

In the past, planar fluorescent lamps have not had sufficient light output to be useful in airplane cockpits, or for backlights for single or double-sided signage, with the ability to tile into large areas. For example, prior art commercial tubes, such as those 4 feet or 8 feet long, generally output 2,500 foot-lamberts when new. Unfortunately, such light sources are tubes and are not flat, planar fluorescent lamps. Unfortunately, flat fluorescent lamps generally have not been able to achieve the light output which is achievable by tubes. It is, therefore, desirable to provide a flat fluorescent lamp having a high light output and uniform brightness.

SUMMARY OF THE INVENTION

According to principles of the present invention, a planar fluorescent lamp includes a sealed chamber having a pair of sidewalls, a pair of end walls, a top plate, and a bottom plate. Divider walls extend from the respective sidewalls to create a serpentine discharge path within the sealed chamber. At each end of the serpentine path, electrodes are positioned to create a serpentine arc discharge within the sealed chamber.

A plurality of sidewall electrodes are spaced from each other and positioned adjacent each sidewall of the chamber. The sidewall electrodes are planar, cold electrode plates. In a preferred embodiment, they are flat, rectangular, planar field emission electrodes. The electrode extends generally from one divider wall to the other divider wall along a single sidewall.

In an alternative embodiment, the sidewall electrodes are within the chamber but are covered by a dielectric layer so that they are not exposed directly to the mercury vapor or an inert gas used in the chamber. Instead, they are separated by the dielectric layer so that an electric field is created within the discharge chamber when power is applied to the electrodes. The dielectric layer is a thin, soft glass layer applied on top of the sidewall electrodes within the chamber. A thin film MgO or other low work function material known in the art is applied to the dielectric layer to aid in increasing efficacy. Alternatively, in a still further embodiment, the sidewall electrodes are positioned completely outside the chamber, either on the sidewall or the bottom plate, chamber walls acting as dielectric layers. In this embodiment, a low work function material, a film or coating, may be placed on the inside of the chamber in a location corresponding to the location of the outside, sidewall electrodes.

The sidewall electrodes are positionable on the sidewall top plate, or the bottom plate or on both plates. In one embodiment, the sidewall electrodes are composed of a layer of a strip of metal, or alternatively, conductive paint which is affixed either to the inside or to the outside of the sidewall.

In one embodiment, the sidewall electrodes are positioned within the chamber, directly exposed to the mercury vapor. A separate power source is connected to each pair of sidewall electrodes so that they may be powered separately from each other and separately from the arc electrodes. This invention allows the lamps to be grouped together in a modular arrangement for light to be emitted uniformly across a large area.

DETAILED DESCRIPTION OF THE INVENTION

Figure 1:
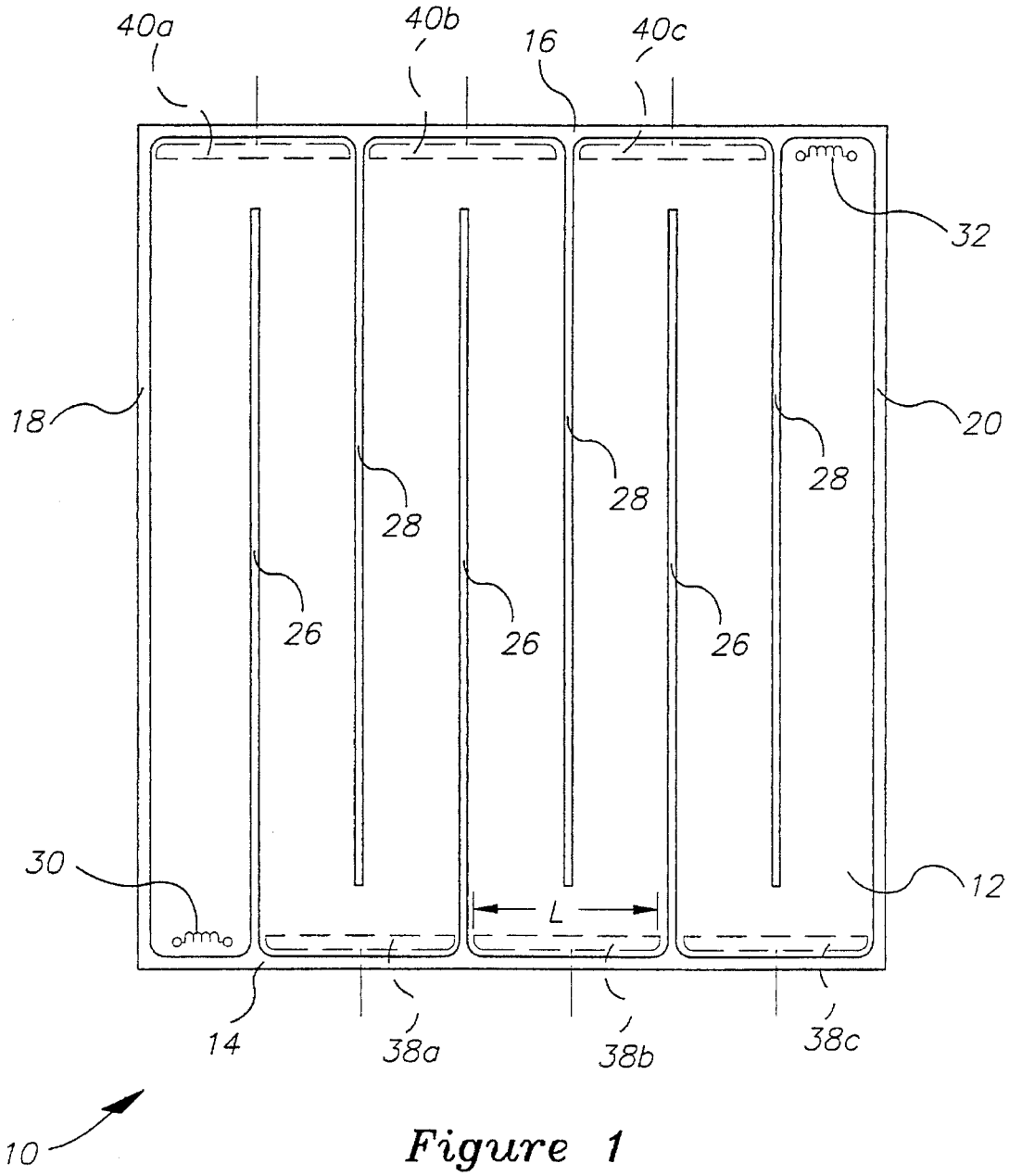
FIG. 1 is a top plan view of a serpentine lamp constructed according to principles of the present invention.
Figure 2:
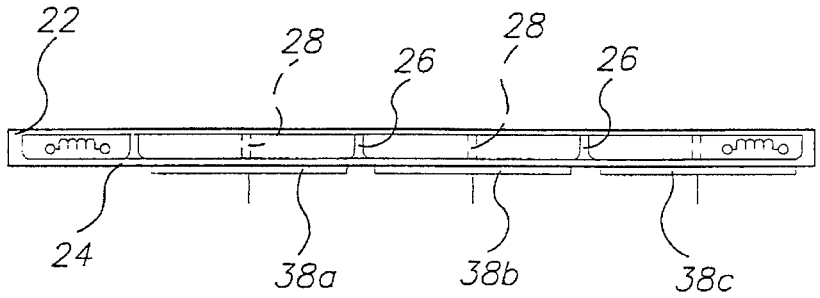
FIG. 2 is an end view of the lamp of FIG. 1.

As shown in FIGS. 1 and 2, the lamp 10 includes a sealed chamber 12. The sealed chamber 12 is an enclosure of a pair of sidewalls 14 and 16, a pair of end walls 18 and 20, and a top and bottom plate 22 and 24, respectively. The sidewalls, end walls, and top and bottom plate form an airtight chamber 12 in a manner well known in the art of mercury fluorescent lamps.

A plurality of divider walls 26 extend from sidewall 14. Similarly, a plurality of divider walls 28 extends from sidewall 16. The divider walls 26 extend towards the sidewall 16, but do not touch it. Similarly, the divider walls 28 extend from the sidewall 16 towards the sidewall 14, but do not contact it. The divider walls thus create a serpentine path through discharge chamber 12. As is well known in the art, a long path is desired for the arc discharge of the fluorescent lamp and the divider walls creates a longer discharge path for the arc than would otherwise be available for a given lamp area.

In the embodiment shown in FIG. 2, the top plate 22 is a flat plate which is affixed to a bottom plate 24 having the sidewalls 26 and 28 extending therefrom.

In an alternative embodiment, both the top plate and the bottom plate are molded faceplates. The molded faceplates each contain a portion of the divider walls 26 and 28 and seal along a horizontal center line allowing equal, two-sided illumination.

In alternative embodiments, any suitably constructed flat chamber lamp that provides a sealed chamber 12 having divider walls 26 and 28 is acceptable.

At each end of the serpentine discharge path is an end electrode, 30 and 32, respectively. The end electrodes can be any commercially available and acceptable thermonic electrode. For example, a directly powered thermionic dispenser electrode as described in U.S. Pat. No. 4,823,044 to Falce is acceptable. In some embodiments, a cold electrode of a type well-known is used. Alternatively, in other embodiments a hot and cold electrode combination, each of a type well-known in the industry, may be used. If desired, a DC power source 34 may be used to raise the electrode to the desired temperature and the AC power source 34 being used to provide the power for the end electrodes 30 and 32. The DC power can be a DC inverter, or a battery, or a standard DC power supply.

Sidewall electrodes 38, labelled individually as 38*a*–38*c*, are positioned along sidewall 14 and sidewall electrodes 40, labelled individually as 40*a*–40*c*, are positioned along sidewall 16. The sidewall electrodes are flat, vertical field emission electrodes in a preferred embodiment. The sidewall electrodes 38 and 40 are a planar, generally rectangular metallic strip, of either metal or conductive paint, and are affixed adjacent the bonds of the serpentine chamber along sidewalls 14 and 16 as shown in FIGS. 1 and 2.

Figure 3:
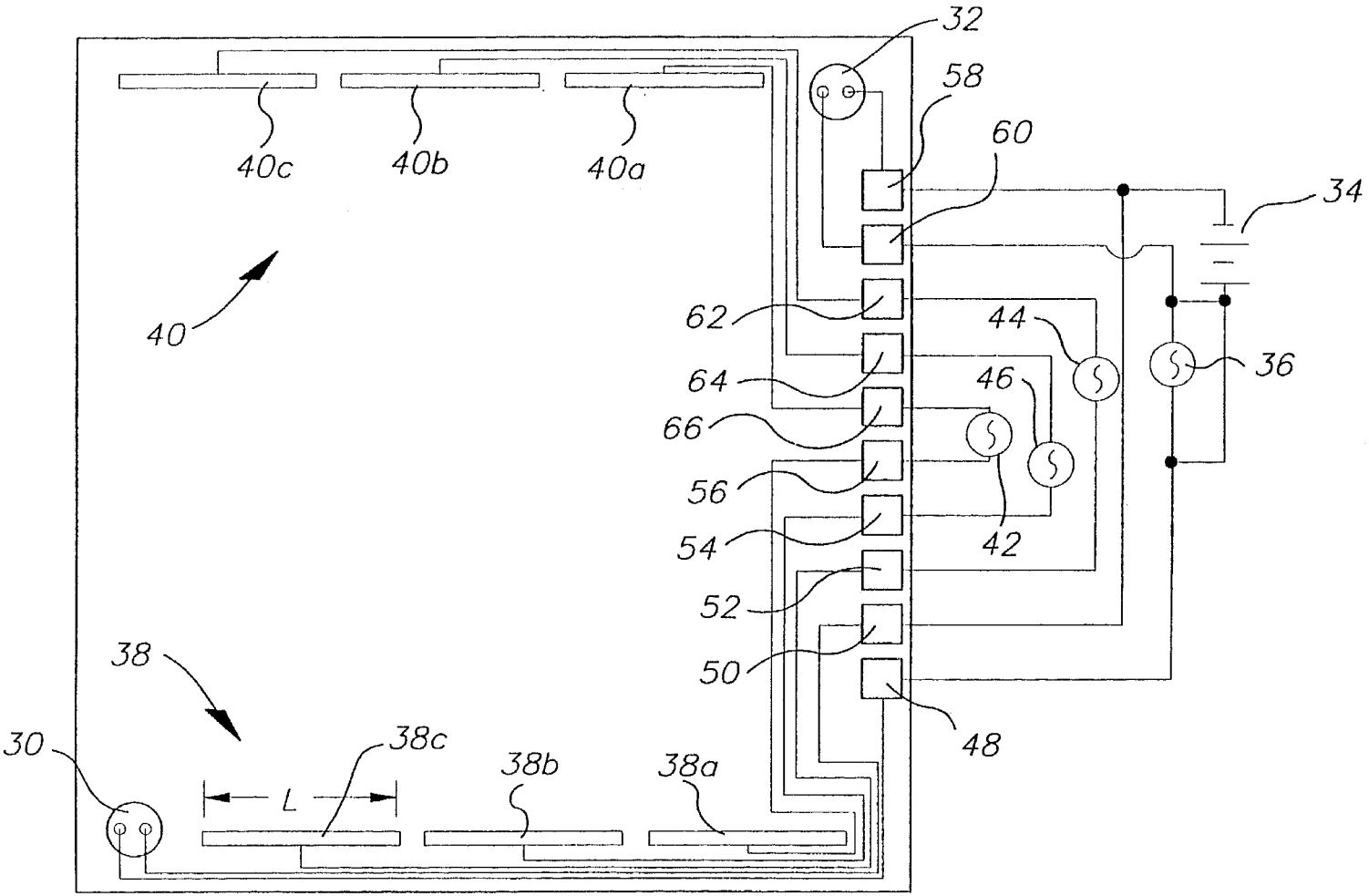
FIG. 3 is a bottom plan view of the serpentine lamp of FIG. 1.

According to the embodiment of FIGS. 1–3, the sidewall electrodes 38 and 40 are attached to the bottom plate 24 to the underside surface of the lamp 10, as best shown in FIGS. 2 and 3. This type of lamp is well-suited for one-sided illumination; that is, light is emitted only from a top plate 12. A reflective film may be applied to the bottom plate 24 to increase the light emitted from the top plate 22.

Preferably, the length L of the sidewall electrodes 38 and 40 is greater than one-half the distance between the respective divider walls 28, as best shown in FIG. 2. In one embodiment, the height H of the vertical sidewall electrodes 38 and 40 (see FIG. 5) is greater than one-half the height of the entire chamber, while in alternative embodiments the vertical height may be approximately equal to, or in some instances less than half the height of the entire chamber.

One purpose of the sidewall electrodes is to modify the shape of the arc discharge within the discharge chamber 12. One of the problems of flat planar lamps is their low light output. Another problem is that flat planar lamps have a tendency to emit non-uniform light. There may be some dark areas in various sidewalls or corners of the lamp, while other portions of the lamp may be brighter. Other problems include dimability and difficulty in starting.

The sidewall electrodes perform at least four functions. First, they increase the overall brightness of the light output from the lamp 10. Second, they increase the uniformity of the light output from the lamp. Sidewall electrodes increase the light uniformity by spreading the arc discharge path within the serpentine chamber 12 to more uniformly fill each corner of the chamber. In addition, in some embodiments sufficient power is applied to the sidewall electrodes 38 and 40 that they create their own, independent electrical discharge to cause the lamp to emit light based solely on their power input.

Third, the sidewall electrode significantly increase the brightness range over which the lamp may be operated. As is well known, one of the disadvantages of current serpentine flat panel fluorescent lamps is that the central portion of the lamp remains dark; not emitting light unless a certain power is applied, above a selected threshold value for a particular lamp. Dimming is extremely difficult because if the power applied to the lamp is reduced, the center portion of the lamp goes dark. Dimming in current lights does not result in a reduction of the light output by a uniform amount across the face of the lamp.

According to the principles of the present invention, the sidewall electrodes permit selected dimming of the lamp while maintaining a uniform brightness across the lamp over a wide range of applied power. For example, as the power to the end electrodes 30 and 32 is reduced, the light begins to dim, outputting a lower light intensity. The sidewall electrodes 38 and 40 maintain a uniform light emission from the lamp across its entire face as it dims, without permitting the interior segments to go completely dark. The power applied to the sidewall electrodes 38 and 40 can also be varied to perform the dimming function and yet maintain a uniform brightness across the face of the lamp.

A fourth function performed by the sidewall electrodes is that of aiding in starting the lamp. When power is first applied to the end electrodes, by simultaneously providing power to the side electrodes, a significant increase in the start speed to full brightness is achieved. In this embodiment, power is continuously applied to the side electrodes 38 and 40 throughout the entire time the lamp is on to continuously maintain the uniform bright output of the lamp.

The sidewall electrodes also permit a longer serpentine chamber to be used. A long discharge path, having many divider walls, is often desired. One problem with long chambers is the difficulty of obtaining a light emission that is uniform, particularly at low voltage or power levels. The sidewall electrodes solve this problem, causing the central region of the lamp to light at power levels well below those of the prior art, thus permitting longer chambers than previously possible.

FIG. 3 illustrates the back side of the lamp 10 of FIGS. 1 and 2. The respective electrodes 38*a*–38*c* are electrically connected in pairs with the electrodes 40*a*–40*c*. Specifically, a terminal from electrode 38*c* is electrically connected to a power source terminal 52. A wire terminal from electrode 38*b* is connected to a power source terminal 54 and a wire terminal from electrode 38*a* is connected to a power source terminal 56. Similarly, electrical connection terminals from electrodes 40*a*, 40*b*, and 40*c* are connected respectively to power source terminals 66, 64, and 62.

Power is provided to the sidewall electrodes in pairs. That is, electrodes 38 and 40 form one or more pairs of facing, sidewall electrodes. An AC power supply 42 is connected between power source terminals 56 and 66 to drive electrodes 38*a* and 40*a* from the same power supply as the single pair. Also, a single power supply 46 is connected to power source terminals 54 and 64 to drive electrodes 38*b* and 40*b* as a pair. Similarly, a single power supply 44 is connected to power source terminals 52 and 62 to drive electrodes 38*c* and 40*c* as a pair. The end electrodes 30 and 32 are also driven from an AC power supply 36. As is well known in the art, a DC power supply 34 may also be applied to the electrodes 30 and 32 to ensure that they maintain sufficient temperature to act as thermionic filaments at all times. (As previously mentioned, cold cathodes, hot cathodes, or combined hot and cold cathodes can be used for end electrodes 30 and 32 and the appropriate power supply as provided for 36 and 34 as is known in the art for end electrodes.)

The frequency of the AC power supply 36 for the end electrodes 30 and 32 can vary over any acceptable range. Presently, a preferred acceptable range is 20–50 KHz. However, the range can be significantly broader because many lamps operate on a frequency of 60 Hz or 400 Hz. Thus, the acceptable frequency range of operation for AC power supply 36 is from 50 Hz to in excess of 50 KHz, depending upon the efficiency and environment of the lamp.

AC power supplies 42, 44, and 46 each operate at a different frequency from each other and each at a different frequency than the end electrode power supply 36. However, the range of operation for each of the power supplies is within the same range. For example, each of the power supplies 42, 44, and 46 can operate in the range of 50 Hz to approximately 50 KHz. However, within that range, the frequency for one power supply to the other will always be different, and preferably sufficiently spaced that there is no interference between the signals. For example, if the end electrodes 30 and 32 are driven from an AC power supply 36 operating at a frequency of 50 KHz, the AC power supply 44 may drive the pair of sidewall electrodes 38*a* and 40*a* at 35 KHz at the same time. Simultaneously, AC power supply 46 may drive the pair of electrodes 38*b* and 40*b* at 30 KHz, while AC power supply 42 drives the pair of electrodes 38*c* and 40*c* at 25 KHz. Of course, the AC frequency can be any frequency within the selected range, as long as they are different for each power supply. As another example, the AC power supply 36 may operate at a high frequency in the range of 45 KHz while each of the pairs of sidewall electrodes are driven by AC power supplies well below 1 KHz, for example at 250 Hz, 400 Hz, and 700 Hz, respectively. It is desirable to have the frequencies of each of the power supplies sufficiently spaced from each other that they do not interfere with each other. Additionally, each of the frequencies are selected to not be a harmonic of another frequency, to ensure that there is no harmonic distortion and to minimize the interference between the frequencies. In one embodiment, a pulsed DC may be used in place of the AC power supplies 36, 42, 44, and 46.

The inventive serpentine lamp using sidewall electrodes has provided significantly higher lumens per watt than has previously been possible from such lamps. In one test of a lamp constructed according to principles of the present invention, 11,300 foot-lamberts was output for a total input of 145 milliamps at approximately 220 volts for the AC power supplies. This is an extremely high, heretofore unattainable light output from lamps of this type for that power input, the invention providing a high number of lumens per watt.

Figure 4:
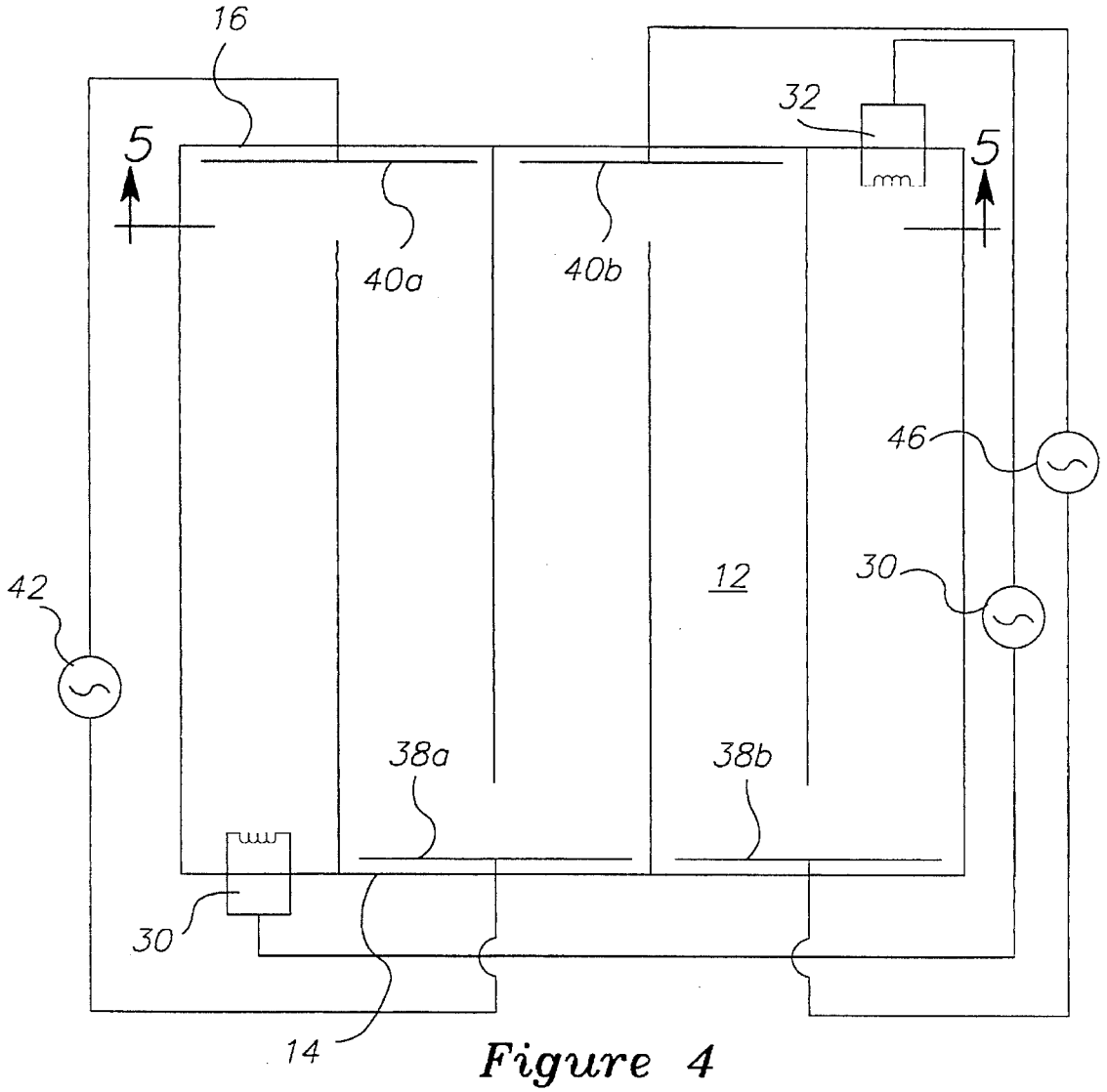
FIG. 4 is a top plan view of an alternative embodiment of a serpentine lamp constructed according to principles of the present invention.
Figure 5:
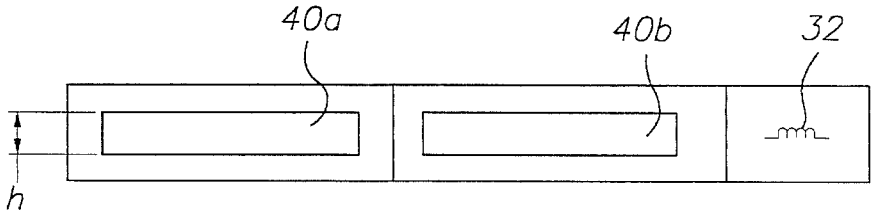
FIG. 5 is a cross-sectional view taken along lines 5—5 of FIG. 4.

FIGS. 4 and 5 illustrate alternative embodiments of the present invention. As shown in FIGS. 4 and 5, the sidewall electrodes 38 and 40 are actually positioned within the sealed chamber 12. In one of these embodiments, the electrodes 38 and 40 are exposed to the mercury vapor of the chamber. In one of these embodiments, the electrodes 38 and 40 are within the chamber, but are covered by a thin dielectric, such as a layer of soft, low melting point glass. Any other thin-film dielectric known in the industry is also acceptable. The thin dielectric prevents the electrode material from being eroded by direct exposure to the vapor. The dielectric layer is sufficiently thin that electrons can pass through it, as would be the case for a thin layer of soft glass, from the electrode to the vapor and vice versa. The dielectric layer is coated with emissive coatings, so that the emissive coating overlays the sidewall electrode. Any of the known emissive coatings are acceptable, including MgO, $LAB_6$, $BaTiO_3$, $Al_2O_3$, $Y_2O_3$, $TiO_2$, $ZnO_2$, $LAB_6$, $SiO_2$, and the like.

According to the embodiment of FIGS. 4 and 5, sidewall electrodes 38 and 40 are strips of sheet metal, cut into rectangular shapes, as best shown in FIG. 5. Preferably, the height h of the strips is in excess of half of the height of the sealed chamber, and the length L is approximately equal to the length between the divider walls 26 and 28, thereby providing a large surface area electrode to evenly spread the electric discharge arc throughout the lamp. While a layer of $BaTiO_3$ may be difficult to apply to sheet metal electrodes, it has a higher dielectric constant than soft glass alone. It may also be desirable to apply MgO over the $BaTiO_3$.

In the embodiment of FIGS. 4 and 5, the terminals extend from the back side of the electrodes 38 and 40, through sealed holes within the chamber and out of the lamp. The terminals connected to the electrodes 38 and 40 are then connected to the appropriate power supplies, either via power source terminals or by direct connection to the power supplies 42 and 46.

Figure 6:
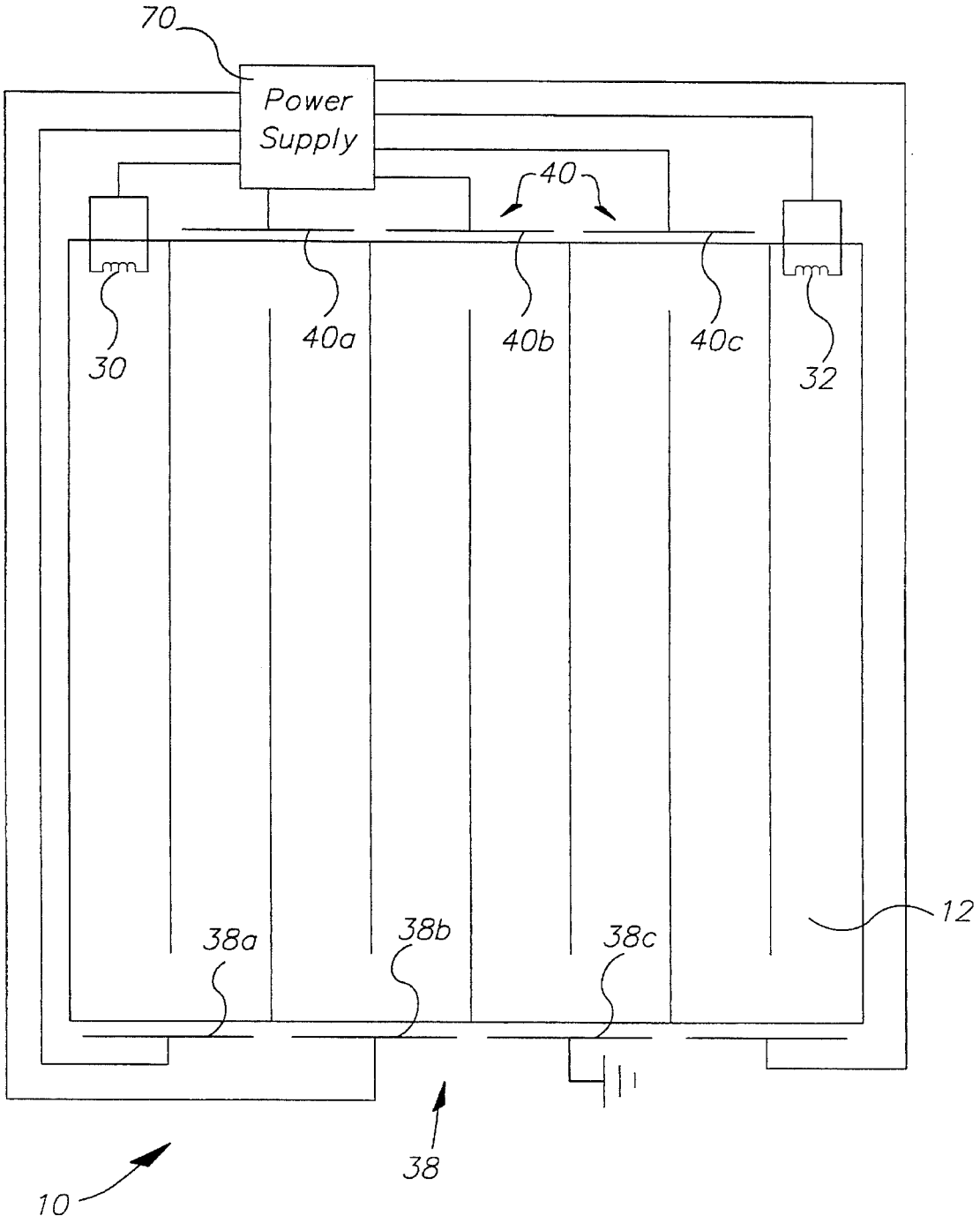
FIG. 6 is a top plan view of a further alternative embodiment of a serpentine lamp constructed according to principles of the present invention.

FIG. 6 illustrates a still further alternative embodiment of the present invention. According to the embodiment of FIG. 6, the electrodes 38 and 40 extend along horizontal sidewalls of the lamp 10 either outside of the lamp 10 or, if within the lamp 10, are covered by a thin dielectric layer so that the electrodes themselves are not directly exposed to the gas vapor within the sealed chamber 12. If the electrodes 38 and 40 are not exposed to the mercury vapor within the sealed chamber 12, a thin layer of conductive paint can be used for these electrodes because they will not be subject to deterioration as may occur if they are exposed to the mercury vapor gas within the chamber 12. The dielectric layer may be a thin layer of a soft glass having a magnesium oxide coating thereon to increase the efficacy. Alternatively, the dielectric layer can be the sidewalls 14 and 16 themselves. Whether inside the chamber or outside the chamber, the electrodes 38 and 40 of FIG. 6 extend along the sidewall horizontally and vertically similar to that shown for the interior electrodes of FIG. 5.

Having the electrodes positioned along the outer surface of the sidewall as shown in FIG. 6 provides illumination from two surfaces, 22 and 24, and completely to the outer edge of the sidewall. This provides the advantage that the lamps can be placed edge-to-edge in a large array without dark spots across the array. The array can be in the form of tiles, modular construction, or the like.

In one preferred embodiment, as illustrated in FIG. 6, a single power supply 70 is used. This single power supply 70 provides the required voltage supply source signals for each respective electrode. For example, the power supply 70 may include a multi-winding transformer and/or a multiple frequency generator. Thus, out of the same power supply, a wide variety of different frequencies at different voltage and current levels can be generated as needed.

According to a further alternative embodiment, as illustrated in FIG. 6, one or more of the electrodes 38 or 40 may be connected to ground. Having the electrode connected to ground provides the same function as having it connected to a driven power supply. That is, ground acts as the voltage source potential (or it may also be referred to the voltage supply source) for the particular electrodes which are grounded. The electrode which is grounded provides the same advantages and functions as those having a voltage supply source connector driven by a power supply. Namely, it serves to spread the plasma discharge arc in a more uniform manner to increase the uniformity of light being emitted by the lamp 10. This is achieved through the grounded electrode by a portion of the plasma discharge arc between 30 and 32 passing through the grounded electrode to ground. There is thus a current conduction path through the grounded electrode, in this Figure electrode 38D, of a portion of the current passing from electrode 30 to electrode 32. If desired, up to one of the electrodes 38 and one of the electrodes 40 can be grounded. However, two electrodes on the same side should not be grounded together because the electrical current path would be from one electrode to the other rather than through the serpentine discharge path. It is desirable to ensure that the plasma arc from electrode 30 to electrode 32 follows the serpentine discharge path of gaseous chamber 12. Of course, if the electrodes 38 are covered with a material providing a sufficiently high resistance, or there is a resistor in the wire connecting the two electrodes together such that the current path from one electrode to another has a significantly higher resistance than the current path through the discharge arc, it may be possible to connect all electrodes of one side together to one power source or to ground and not cause a current path that passes through the electrodes rather than through the arc of serpentine chamber 12. Thus, in the embodiment in which a high resistance is provided from one electrode 38*a* to one adjacent 38*b*, it may be possible to drive adjacent electrodes with the same power signal or connect them all to ground.

Figure 7:
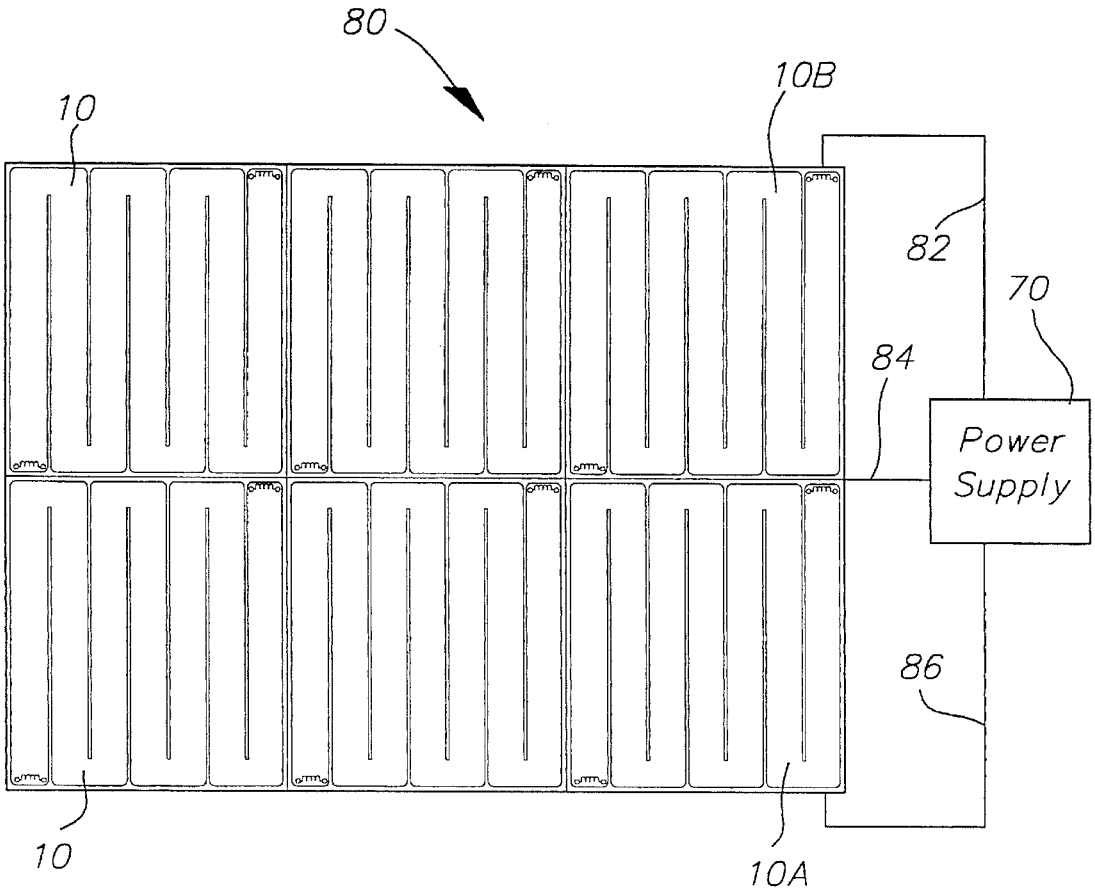
FIG. 7 is a top plan view of many lamps connected together in a modular arrangement.

FIG. 7 is a top plan view of six lamps 10 connected in a modular arrangement to form a single lamp light source 80. The lamps 10 are connected edge-to-edge to form the single large area light source 80. The power supply 70 provides the correct number of wires, labelled as 84, to power the individual sidewall electrodes on walls of each lamp 10 along the sidewalls that abut each other. Power is provided on wires 82 and 86 to the other electrodes, including thermonic cathodes and sidewall electrodes, in a manner previously described.

Preferably, two electrodes that are adjacent each other in two separate lamps 10 are coupled to the same voltage source, to reduce the wire connections. In one embodiment, a single sidewall electrode is shared by two different lamps 10. The single sidewall electrode is positioned between the lamps 10 and located properly to cause the light emitted by each respective lamp to provide uniform light distribution, as has been previously described.

For example, between the two lamps 10*a* and 10*b*, there are three sidewall electrodes, each spaced longitudinally along the interface between the two lamps 10*a* and 10*b*. Rather than requiring six sidewall electrodes (three for each lamp 10*a* and 10*b*), only three are needed, because the lamps are sufficiently close together to share sidewall electrodes along the abutting sides. In this embodiment, the electrodes are along the outside of the exterior wall, similar to the physical position shown in FIG. 6, but they are so thin they cannot be seen in FIG. 7.

Having the sidewall electrodes on the outside wall of the lamps in the modular arrangement produces the added benefit of having uniform light distribution across the modular unit. Light enters the glass of the sidewall and is reflected out, so that the lamp emits light across its entire face. Light is uniformly emitted from both the top plate and the bottom plate, the sidewall electrodes being positioned on the side.

The modular construction is useful for signs because a single light source 80 can provide illumination from two surfaces. A large sign on each surface is provided with uniform backlight using many lamps in a modular construction array.

Numerous alternative embodiments of sidewall electrodes and their respective power supplies are illustrated herein. As will be evident to those of ordinary skill in the art, the features of one alternative embodiment may be combined with the features of other alternative embodiments to produce a lamp 10 operating according to principles of the present invention. Further, modifications of the structures taught herein, or use of equivalent structures to provide the same function, falls within the scope of the present invention.

I claim:

1. A planar fluorescent lamp comprising:

a sealed chamber formed by a pair of sidewalls, a pair of end walls, a top plate, and a bottom plate;

a gas within the sealed chamber, the gas being active to emit ultraviolet energy in response to an electric plasma arc therethrough;

a plurality of divider walls extending from each of said sidewalls and from the bottom plate to the top plate to create a serpentine path having a plurality of turns within the sealed chamber;

a electrode at each end of the serpentine path of the sealed chamber positioned for creating the electric plasma arc within the sealed chamber between the electrodes; and a first sidewall electrode positioned adjacent a first one of the sidewalls, the first sidewall electrode having an electric terminal that is adapted to be connected to a voltage source, the first sidewall electrode further being positioned to modify the shape of the electric plasma arc within the sealed chamber at a corresponding first one of the turn in response to an input voltage from the voltage source.

2. The lamp according to claim 1 wherein the sidewall electrode is a planar electrode that conforms substantially to the sidewall and extends approximately from one divider wall to an adjacent divider wall or endwall along the first one of the sidewalls.

3. The lamp according to claim 1 further including a second sidewall electrode positioned adjacent the second one of the sidewalls, the second sidewall electrode having a second electric terminal that is adapted for electrical connection thereto, the second sidewall electrode being positioned to modify the shape of the electric plasma arc within the sealed chamber at a corresponding second one of the turns in response to an input voltage at the second electric terminal.

4. The lamp according to claim 3, further including:

a plurality of power source terminals attached to the bottom plate of the lamp; and an electrical connection extending from each sidewall electrode terminal to a respective power source terminal.

5. The lamp according to claim 4, further including a voltage source connected to each of the power source terminals.

6. The lamp according to claim 4, further including:

a phosphor layer within the sealed chamber and exposed to the mercury vapor gas such that ultraviolet energy emitted by the gas strikes the phosphor layer.

7. The lamp according to claim 4, further including a phosphor layer outside of the sealed chamber and positioned to permit U.V. light emitted from the chamber to impinge thereon.

8. The lamp according to claim 3, further including a first voltage source connected to the first and second sidewall electrodes, a portion of the serpentine path providing a conductive path from the first sidewall electrode through the mercury gas vapor of the sealed chamber and to the second sidewall electrode.

9. The lamp according to claim 8 wherein the first voltage source is an A.C. voltage source operating at a first frequency, further including a second voltage source connected to the end electrodes, the second voltage being an A.C. voltage source operating at a second frequency, the second frequency being a different frequency than the first frequency.

10. The lamp according to claim 9, further including:

a third sidewall electrode along the first sidewall, the third sidewall electrode having a third electric terminal for connection thereto, the third sidewall electrode being positioned to modify the shape of the electric plasma arc discharge within the sealed chamber at a third one of the turns;

a fourth sidewall electrode positioned along the second sidewall, the fourth sidewall electrode having a fourth electric terminal for connection thereto, the fourth sidewall electrode being positioned to modify the shape of the electric plasma arc discharge within the sealed chamber at a fourth one of the turns; and a third voltage source operating at a third frequency connected to the third and fourth sidewall electrodes.

11. The lamp according to claim 10 wherein the third frequency is different from the first and second frequencies.

12. The lamp according to claim 1, further including a second sidewall electrode positioned adjacent the first one of the sidewalls, the second sidewall electrode having a second electric terminal that is adapted for electrical connection thereto, the second sidewall electrode being positioned to modify the shape of the electric plasma arc within the sealed chamber at a corresponding second one of the turns in response to an input voltage at the second electric terminal.

13. The lamp according to claim 12, further including a third sidewall electrode positioned adjacent the second one of the sidewalls, the third sidewall electrode having a third electric terminal for electrical connection thereto, the third sidewall electrode being positioned to modify the shape of the electric plasma arc within the sealed chamber at a corresponding third one of the turns in response to an input voltage at the third electric terminal.

14. The lamp according to claim 1 wherein the sidewall electrodes are within the chamber but are completely covered by a thin dielectric layer so that they are not directly exposed to the mercury vapor gas.

15. The lamp according to claim 1 wherein the sidewall electrodes are outside the chamber and are positioned along an outside surface of the sidewall.

16. The lamp according to claim 15 wherein the sidewall electrodes are composed of a conductive paint affixed along an outside surface of the sidewall.

17. A planar fluorescent lamp comprising:

a lamp body having a plurality of sidewalls and end walls, and a bottom plate;

a lamp cover overlaying the lamp body, wherein the lamp cover, sidewalls and end walls define a chamber;

a divider wall extending from each of said sidewalls toward an opposite sidewall and projecting from the bottom plate toward the cover to define a serpentine path having a plurality of turns within the chamber;

a gas within the chamber;

a first electrode within the serpentine path;

a second electrode spaced apart from the first electrode within the serpentine path, the first and second electrodes positioned for creating an electric plasma arc within the sealed chamber along a portion of the serpentine path;

a first sidewall electrode positioned adjacent a first one of the sidewalls within the portion of the serpentine path, the first sidewall electrode being positioned to modify the shape of the electric plasma arc at a corresponding first one of the turns in response to an input voltage; and a second sidewall electrode positioned adjacent the second one of the sidewalls in the portion of the serpentine path, the second sidewall electrode being positioned to modify the shape of the electric plasma arc at a corresponding second one of the turns in response to an input voltage.

18. The lamp according to claim 17, further including a first voltage source connected to the first and second sidewall electrodes, a section of the serpentine path providing a conductive path from the first sidewall electrode through the gas of the sealed chamber and to the second sidewall electrode.

19. The lamp according to claim 18 wherein the first voltage source is an A.C. voltage source operating at a first frequency, further including a second voltage source connected to the end electrodes, the second voltage being an A.C. voltage source operating at a second frequency, the second frequency being a different frequency than the first frequency.

* * * * *